US005505181A

United States Patent [19]

McRae et al.

[11] Patent Number: 5,505,181

[45] Date of Patent: Apr. 9, 1996

[54] INTEGRAL PRESSURE DAMPER

[75] Inventors: Kenneth J. McRae, Norfolk; Michael J. Hornby, Williamsburg, both of Va.

[73] Assignee: Siemens Automotive Corporation, Auburn Hills, Mich.

[21] Appl. No.: 387,682

[22] Filed: Feb. 13, 1995

[51] Int. Cl.[6] ..... F02M 55/02

[52] U.S. Cl. ..... 123/510; 123/511; 123/456; 123/469

[58] Field of Search ..... 123/510, 511, 123/514, 456, 467, 468–469

[56] References Cited

U.S. PATENT DOCUMENTS

| | | | |
|---|---|---|---|
| 2,737,167 | 3/1956 | Dickey | 123/511 |
| 4,457,280 | 7/1984 | Hudson, Jr. | 123/468 |
| 4,596,219 | 6/1986 | Kemmner | 123/467 |
| 4,608,957 | 9/1986 | Kemmner | 123/467 |
| 4,615,320 | 10/1986 | Fehrenbach et al. | 123/467 |
| 4,646,700 | 3/1987 | Tuckey | 123/510 |
| 4,649,884 | 3/1987 | Tuckey | 123/510 |
| 4,653,528 | 3/1987 | Field et al. | 123/468 |
| 4,660,524 | 4/1987 | Bertsch et al. | 123/468 |
| 4,664,142 | 5/1987 | Bertsch et al. | 123/510 |
| 4,729,360 | 3/1988 | Fehrenbach et al. | 123/467 |
| 4,805,575 | 2/1989 | de Concini et al. | 123/468 |
| 5,012,784 | 5/1991 | Fehrenbach | 123/467 |
| 5,094,211 | 3/1992 | Mahnke et al. | 123/467 |
| 5,284,120 | 2/1994 | Fukushima et al. | 123/510 |
| 5,411,297 | 5/1995 | Brown | 123/468 |

*Primary Examiner*—Thomas N. Moulis
*Attorney, Agent, or Firm*—Russel C. Wells

[57] ABSTRACT

An integral pressure damper is designed for use with an internal combustion engine having a fuel return line and a fuel rail in a fuel system that requires a damper. The integral pressure damper comprises a fitting securable to the fuel return line, and a damper assembly securable to the fitting. The fitting is securable to the return line. The present invention allows the flexibility of attaching the return line to the fuel rail using braze or any other suitable attachment process, before the damper is attached to the return line. The damper is subsequently secured to the fitting, such as by crimping a housing of the damper to the outside of the fitting, or by crimping the fitting to the outside of the housing.

2 Claims, 1 Drawing Sheet

INTEGRAL PRESSURE DAMPER

FIELD OF THE INVENTION

This invention relates generally to fuel injection for injecting liquid fuel into an internal combustion engine, and particularly to an integral pressure damper in a fuel return line for reducing audible operating noise produced by injector pressure pulsations in such an engine.

BACKGROUND OF THE INVENTION

Damper devices are well known in the internal combustion engine art. The damper device, when installed in an automotive fuel system, reduces noise produced by injector pressure pulsations. Fuel injectors are attached to a fuel rail, which receives a supply of fuel from a fuel tank. Unused fuel is returned to the fuel tank through the damper, located in a fuel return line.

Currently, dampers are supplied as a brazed sub-assembly, with the damper brazed to the return tube. This requires attachment of the damper/return tube assembly to the fuel rail, via an attachment means such as a clip, fastener or other post braze means. Unfortunately, the post braze means cannot be a separate brazing process, because the damper attached to the return tube will not survive the braze oven. Hence, even though a braze can provide an improved joint, a disadvantage with the state of the art is that the brazing process cannot be used to attach the return tube, containing the damper, to the fuel rail.

It is seen then that it would be desirable to have an improved an simplified assembly process for attaching the damper to the return line and the return line to the fuel rail assembly, which overcomes the disadvantages associated with the prior art.

SUMMARY OF THE INVENTION

This need is met by the integral pressure damper design according to the present invention, wherein assembly process of damper to return line and return line to fuel rail is simplified. The damper design of the present invention simplifies the installation of the device to the fuel system and allows for greater flexibility when designing the fuel rail system manufacturing process. With the present invention, flexibility to attach the return tube to the rail, without the damper, using either braze or some other post braze method now exists. This is possible because the damper can now be attached to the return tube independently of the sequence and method used to attach the return tube to the rail. The present invention allows for major cost saving implications by making the manufacturing process both simpler and more flexible.

Briefly, the invention comprises the implementation of certain constructional features into the regulated fuel path of an internal combustion engine. Principles of the invention are of course potentially applicable to forms of fuel injection systems other than the one specifically herein illustrated and described.

In accordance with one embodiment of the present invention, the damper is attached to the return tube by crimping the damper to the outside of a fitting brazed to the return line.

In accordance with a second aspect of the present invention, the damper is attached to the return tube by crimping the fitting, brazed to the return line, to the outside of the damper.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
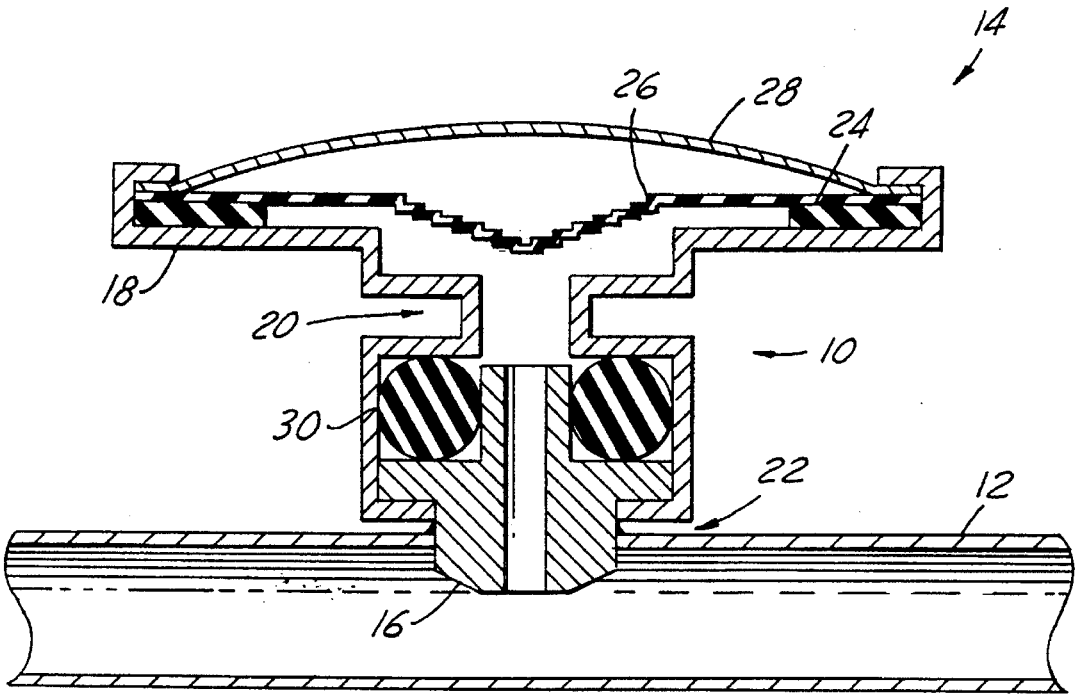
FIG. 1 is a view, partly in cross section, embodying one form of the present invention.

Referring to FIG. 1 there is illustrated a detailed drawing section of an integral damper 10, in accordance with the present invention. The damper 10 is crimped to return line 12 of a fuel rail assembly 14, via a fitting 16. A first sub-assembly comprises brazing the fitting 16 to the return line 12.

A second sub-assembly comprises assembly of the damper 10. The integral damper 10 comprises a housing 18. The housing 18 can assume a variety of contours, such as that illustrated in FIG. 1, wherein the housing follows a concavity 20, before crimping around the fitting 16 at location 22. A gasket 24 provides a seal between the housing 18 and a diaphragm 26. A cover 28 encloses the damper assembly 10 within the housing 18. The second sub-assembly, comprising the integral damper assembly, is attached to the first sub-assembly by a crimping method which secures the second sub-assembly to the first sub-assembly at crimp location 22. An o-ring 30 is used as a sealing device between the first sub-assembly and the second sub-assembly.

The present invention provides flexibility in attaching the return tube 12, without the damper, to the fuel rail (not shown). Either braze or any other suitable post braze method can now be used to attach the return line to the fuel rail. This is possible because the damper can now be attached to the return tube independently of the sequence and method used to attach the return tube to the fuel rail. That is, the fitting 16 can be brazed to the return line, either before, simultaneously with, or after the brazing of the return line to the fuel rail. Subsequent to the brazing steps, the damper can be crimped or otherwise attached to the fitting, to secure the damper to the return line.

It will be obvious to those skilled in the art that varying methods of attachment can be used to secure the damper to the fitting and, thus, to the return line, without departing from the scope and spirit of the invention. It will also be obvious to those skilled in the art that with whichever method of attachment is used, including a crimping method, there are various designs for instituting the attachment.

Figure 2:
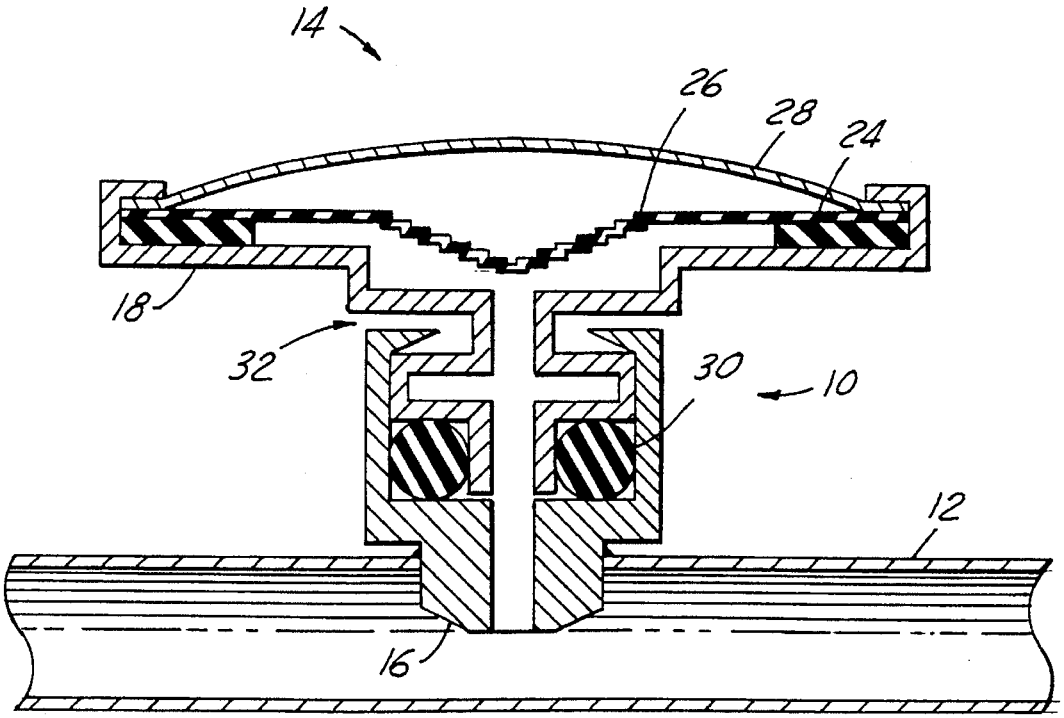
FIG. 2 is a view, partly in cross section, illustrating a modified form of the invention.

Referring now to FIG. 2, a modified form of the damper design described with reference to FIG. 1 is illustrated, which allows for a different means of crimping the damper 10 to the return tube 12. In FIG. 1, the crimp is achieved at crimp location 22 by crimping the housing 18 to the outside of the fitting 16. Alternatively, in FIG. 2, the crimp is achieved at crimp location 32, by crimping the fitting 16 to the outside of the housing 18. An o-ring 30 is again used as a sealing device between the first sub-assembly and the second sub-assembly. Both methods of attachment in FIGS. 1 and 2 can be used on any fuel system that requires a damper.

Having described the invention in detail and by reference to the preferred embodiments thereof, it will be apparent that principles of the invention are susceptible to being implemented in other forms of solenoid-operated valves without departing from the scope of the invention defined in the appended claims.

What is claimed is:

1. In a fuel injection system for an internal combustion engine comprising:

a source of fuel;

at least one fuel injector for injecting fuel into the engine;

a fuel rail operatively connected to said source of fuel for conveying fuel from said source to said at least one injector, said injector creating fuel pulsation in said fuel rail during opening and closing of said injector;

pump means operatively connected to said source of fuel for moving said fuel from said source to said fuel rail, said pump means creating fuel pulsations in said fuel rail;

a fuel return fuel line connected to said fuel rail for returning fuel to said fuel source;

pressure damper means for damping said fuel pulsations formed from the operation of said pump means, said pressure damper having an attaching means; and a damper fitting secured to said fuel return line for receiving said attaching means and wherein said damper means is crimped to said fitting.

2. A fuel injection system according to claim 1 further comprising a sealing means for providing a seal between said fitting and said attaching means of said pressure damper means.

* * * * *